US005826747A

United States Patent [19]

Bohler

[11] Patent Number: 5,826,747

[45] Date of Patent: Oct. 27, 1998

[54] APPARATUS AND METHOD FOR DISPENSING PILLS

[76] Inventor: Gerard M. Bohler, R.D. 2 Box 528, Pine Grove, Pa. 17963

[21] Appl. No.: 766,949

[22] Filed: Dec. 16, 1996

[51] Int. Cl.[6] ..... B23Q 7/04

[52] U.S. Cl. ..... 221/210; 215/227

[58] Field of Search ..... 221/210, 259, 221/288, 186, 188, 277; 215/227

[56] References Cited

U.S. PATENT DOCUMENTS 2,361,580 10/1944 Waring ..... 221/210
3,092,281 6/1963 Davidson ..... 215/228
3,797,875 3/1974 den Hamer ..... 294/1 R
5,490,610 2/1996 Pearson ..... 221/2

*Primary Examiner*—Kenneth Noland
*Attorney, Agent, or Firm*—Kenyon & Kenyon

[57] ABSTRACT

An apparatus and method for dispensing pills that is easily and effectively implemented by individuals with impaired use of their hands. A adhesive area is disposed on the inside of a cap for a bottle containing pills, or on a stem fixed to the inside of the cap and extending into the bottle when the cap seals the bottle. When the bottle is agitated, one or more pills contact the adhesive and become releasably attached thereto. When the cap is removed, the pill is conveniently presented to the consumer for easy removal.

16 Claims, 4 Drawing Sheets

APPARATUS AND METHOD FOR DISPENSING PILLS

BACKGROUND OF THE INVENTION

Medication in the form of pills is often dispensed in conventional bottles with caps. A bottle may contain as many as 500 or 1000 pills, which may have diameters as small as a few millimeters or as large as a centimeter or more. Extracting a specific number of pills from a bottle can sometimes be difficult, particularly for individuals with arthritis or some other physical impairment. This is especially true when the bottle in which the pills are stored is hard to handle, or the pills themselves are too small or slippery to handle easily.

In order to remove a specific number of pills from a bottle, a consumer usually removes the top and attempts to shake the proper number into his hand. Except for those with sufficient dexterity, this can be exceedingly difficult, especially for small pills, and for bottles whose neck or mouth is poorly configured to pass the requisite number of pills.

Excess pills beyond the required number often spill out of the bottle and into the consumer's hand, and occasionally spill onto the floor. This causes some pills to be lost, which is expensive and can prevent the consumer from finishing the full course of a prescribed regimen of medication. The consumer may try to return the extra pills that have fallen into his hand or on the floor back into the bottle. These extra pills have generally picked up contaminants from the hand or floor, including dirt, oils, bacteria, viruses, and spores. When returned to the bottle, these contaminants can spread to the rest of the pills. Further, the spilled pills have been exposed longer than necessary to air and light, which can degrade the potency of some medications.

Alternatively, a consumer may try to reach into the bottle and retrieve the right number of pills. This is not a realistic option for many medications, which are dispensed in bottles with mouths or necks that are too narrow to permit retrieval in this manner. Further, many kinds of pills are too small or slippery to be extricated effectively from a bottle in this way. Even if the mouth of the bottle is wide enough to accommodate the thumb and forefinger, and if the pills are sized to be grasped easily, reaching into a bottle exposes many pills besides those ultimately selected to dirt, oils, and bacteria from the hand, as well as other contaminants. Some pills may also be broken in this process, rendering them practically useless.

Obtaining the right number of pills from a bottle is an especially acute problem for those who, for one reason or another, do not enjoy the full range of normal use of their hands. For example, those afflicted with arthritis in their hands, or else a more general nervous disorder such as palsy, are more likely to have great difficulty in properly extracting the proper number of pills from a bottle by any known system or method.

The present invention overcomes pill retrieval problems caused by arthritis or other physical impairments involving the hands by providing an inexpensive and sanitary way to retrieve one or more pills from a bottle. This can be accomplished for a wide range of pill types, shapes and sizes stored in practically any bottle used to contain pills.

SUMMARY OF THE INVENTION

The present invention provides a cap with an adhesive disposed to releasably fix at least one pill from the inside of a bottle upon contact, and then to easily present the pill to the consumer for easy retrieval. The present invention advantageously facilitates the extraction of pills from a bottle for those with an impairment of the hands.

In one embodiment of the present invention, adhesive is provided on the inside of the cap. This is especially convenient for use with bottles with wide mouths. The consumer seals the bottle with the cap and agitates the bottle so that at least one pill contacts and adheres to the adhesive. The consumer then removes the cap, and the pill is presented to the consumer for easy removal from the cap. This embodiment operates best for caps with large enough diameters so that the wall of the cap does not interfere with the pill retrieval process.

In another embodiment, the adhesive is disposed on the end of a stem fixed to the inside surface of a cap. The term "inside surface" here means the surface of the cap that faces the inside of a bottle when the cap seals the bottle, and is meant to encompass any liners or gaskets fixed to the cap that face the inside of a bottle. When the bottle is sealed with the cap, the stem extends from the cap into the bottle. The consumer seals and agitates the bottle so that at least one pill contacts and releasably adheres to the adhesive at the end of the stem. When the cap is removed, the pill is conveniently presented to the consumer to be plucked from the end of the stem. This is especially advantageous for use with bottles with narrow mouths or necks, and for small pills.

In yet another embodiment, the adhesive is disposed on the side of a stem fixed to the inside surface of a cap, the stem extending into the bottle when the cap seals the bottle. The bottle is agitated and at least one pill contacts and releasably adheres to the adhesive on the side of the stem. When the cap is removed, the pill is presented to the consumer on the side of the stem. This embodiment is advantageous for a wide range of pill sizes and bottle mouth and neck diameters.

The present invention may be configured to extract more than one pill from a bottle by arranging more than one separate adhesive area on the inside of a cap or on a stem. When the bottle is agitated, one pill is fixed to each adhesive area, advantageously and reliably providing a multi-pill dosage to the consumer.

The number of pills extracted at one time may be controlled in accordance with the present invention by the consumer by providing removable tabs that cover multiple adhesive areas disposed on the inside of a cap or on a stem. The consumer removes the number of tabs corresponding to the number of pills desired to be extracted from the bottle at one time. The rest of the adhesive areas remain covered by tabs. When the bottle is agitated, one pill is fixed to each uncovered adhesive area, thus provided the correct consumer-selected number of pills.

The use of removable tabs also advantageously provides a means for maintaining the functionality of the present invention when an exposed adhesive area is contaminated, compromising its adhesive properties. If an adhesive area no longer fixes a pill, the consumer need only remove a tab covering another adhesive area, and the present invention may continue to extract pills for the consumer.

In another embodiment of the present invention, the stem fixed to the cap is hollow and filled with adhesive. When the exposed adhesive area is contaminated such that its adhesive properties are compromised, the consumer pulls away the contaminated adhesive and pinches or cuts it off. Fresh adhesive from inside the stem replaces the contaminated adhesive on the tip, enabling the present invention to continue to extract pills. In accordance with the present invention, the exposed adhesive area can be situated on either or both of the side of, or at the end of, the stem.

The present invention provides a means for reliably, safely and cleanly extracting at least one pill at a time in a controlled fashion from a wide variety of bottles by a consumer with either healthy or impaired hands. It eliminates the problem of taking too many pills out of the bottle, exposing them to contamination, and then having to throw the extra pills away or else return them to the bottle, thus contaminating the rest of the pills. It also eliminates the problem of spilling pills on the floor in the process of extracting them from the bottle. The present invention is advantageously easily usable by those who have limited or impaired use of their hands, especially when compared to previously known methods of extracting pills from a bottle.

DETAILED DESCRIPTION

Figure 1:
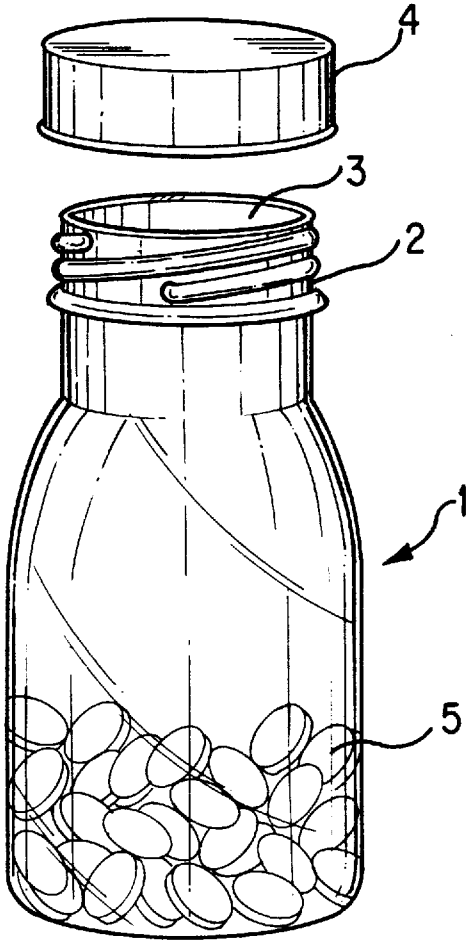
FIG. 1 shows a known method of storing pills.

FIG. 1 shows a typical example of a known pill dispenser, comprising a bottle 1 with a neck 2 and mouth 3. The bottle 1 is sealed with a cap 4 which must be removed in order to retrieve the pills 5 inside. The cap 4 may be made as a single piece of material, or its inside surface may be lined with a gasket made of paper, plastic, or some other material. The term "cap" herein is used to represent a cap either with or without such a lining.

Pills maybe obtained from this known dispenser by inverting bottle 1 and shaking pills 5 out through the neck 2 and mouth 3 into the consumer's hand. This often results in too many pills 5 being dispensed, or else spilling pills on the floor. Extra retrieved pills are often returned to the bottle 1, contaminating the rest of the pills 5 in the bottle 1 with dirt, oils, bacteria and other contaminants which the extra pills picked up in the consumer's hand or on the floor.

In accordance with the present invention, pills are brought into contact with an adhesive area inside a bottle that releasably fixes the pills. When the bottle is opened, the adhesive area to which the pills are releasably attached is then conveniently presented to the consumer, who easily removes the pills from the adhesive area.

The adhesive used in the present invention is non-toxic, and releasably fixes a pill such that when the pill is removed, a negligible amount of the adhesive sticks to the pill.

A suitable adhesive is FILM GRIP 33-4044, formerly 72-3326, manufactured by the National Starch and Chemical Company, Adhesives Division, 10 Finderne Avenue, Bridgewater, N.J. FILM GRIP is an adhesive formulated as a pressure sensitive emulsion adhesive, having about 59% solids, a viscosity of about 1600 cps, a pH of about 4.6, and a density of about 8.6 pounds per gallon. FILM GRIP is an adhesive with good wet tack that adheres well to difficult surfaces, such as polyolefins. FILM GRIP has very good cohesive strength, and sticks to itself sufficiently to ensure that an insignificant amount (if any) of the adhesive continues to adhere to a pill once the pill is removed from the adhesive by the consumer.

The adhesive area is sized to releasably fix a predetermined number of pills and to remain substantially fixed to a cap or stem when a consumer removes a pill that is releasably fixed to the adhesive area. This is achieved by assuring that the footprint of the adhesive on the cap or stem is greater than the footprint of the adhesive on a releasably fixed pill. An roughly circular or semi-spherical adhesive area from about one twenty fifth to one half of the diameter of a pill releasably fixes a single pill such that the adhesive area remains fixed to the cap or stem when the consumer removes a pill releasably fixed to the adhesive area. Adhesive areas smaller than one twenty fifth the diameter of a pill are often too small to releasably fix a pill, whereas adhesive areas more than one half the diameter of a pill often fix more than one pill per adhesive area one tenth the diameter of a pill generally best suffices to fix a single pill, although adhesive areas from one twenty fifth to one half the size of the pill have been found to be effective in fixing a single pill. More than one pill may be fixed per adhesive area, but a precise number of pills is most reliably fixed if each adhesive area is dimensioned to releasably fix only one pill at a time.

In accordance with the present invention, pills are releasably fixed to an adhesive area by sealing the bottle with the cap and agitating the bottle. When the bottle is agitates, pills are brought into contact with the adhesive and are releasably fixed. Here, the term "sealing the bottle" means covering the mouth of the bottle sufficiently with the cap such that when the bottle is agitated, pills do not spill out. The cap need not be screwed down in order to seal the bottle to carry out the method of the present invention.

Figure 3:
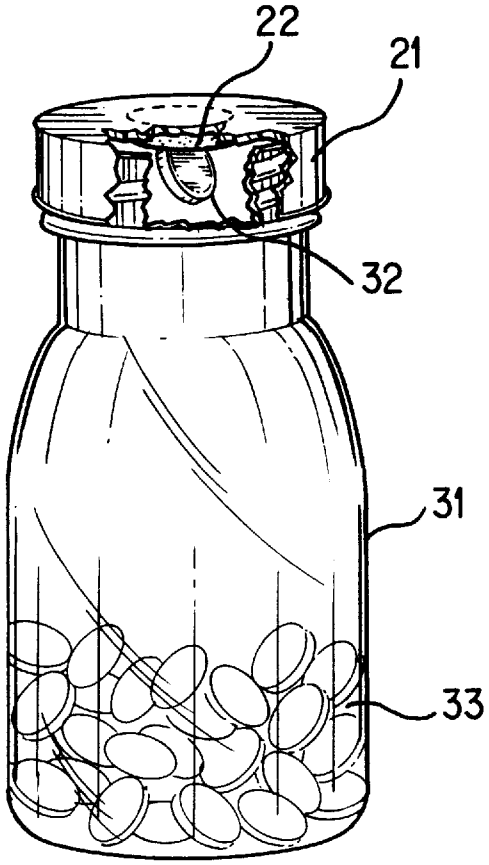
FIG. 3 shows the cap of FIG. 2 sealing fixed a bottle containing pills.
Figure 2:
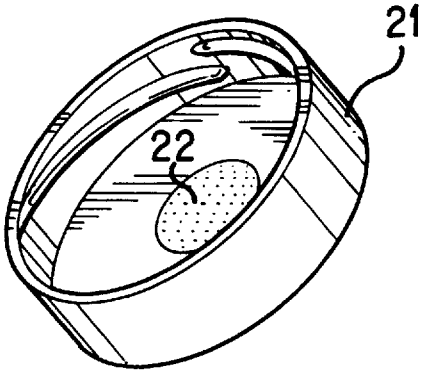
FIG. 2 shows an embodiment of the present invention comprising a adhesive area disposed the inside surface of a cap.

FIG. 2 shows an embodiment of the present invention where a cap 21 is provided with an adhesive area 22. As discussed above, the cap 21 may be of single piece construction, or else have a liner on its inside surface. In the event the cap 21 has a liner on its inside face, the adhesive area is disposed on side of the liner that faces the inside of the bottle 31 (see FIG. 3) which the cap is used to close. On any cap, the adhesive area is disposed to make contact with the pills inside a bottle when the cap seals the bottle. The cap may be of virtually any kind and made of virtually any material, provided there is an area on its inside face upon which an adhesive area may be fixed. Likewise, the bottle may be of any kind that is suitable for containing pills.

Figure 4:
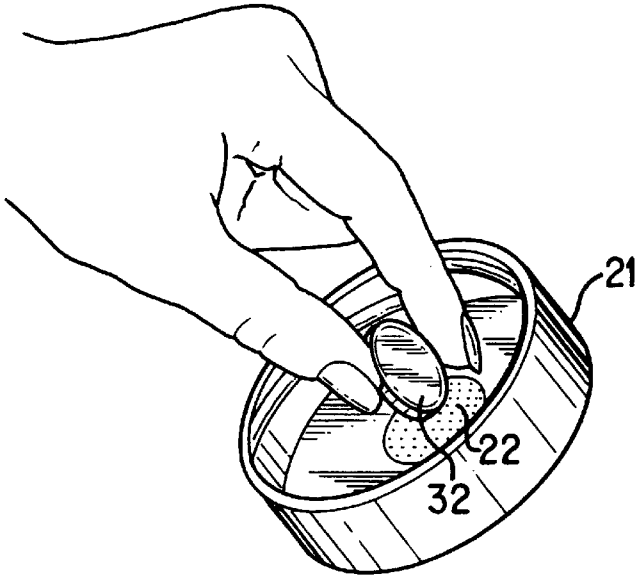
FIG. 4 shows a pill releasably fixed to the adhesive area on the cap of FIG. 2.

When the cap 21 is placed over the mouth of a bottle 31 (FIG. 3) and the bottle 31 is agitated, a pill 32 in the bottle contacts the adhesive area 22 and is releasably retained by the adhesive area 22. The rest of the pills 33 remain in the bottle 31. The consumer then removes the cap 21 and retrieves the pill 32 by picking it off of the adhesive area 22, as shown in FIG. 4. Alternatively, the consumer inverts the cap with pill over his hand and gently shakes the cap or taps the edge of the cap on her hand, thus releasing the retrieved pill from the adhesive, and the pill falls into her hand.

Figure 5:
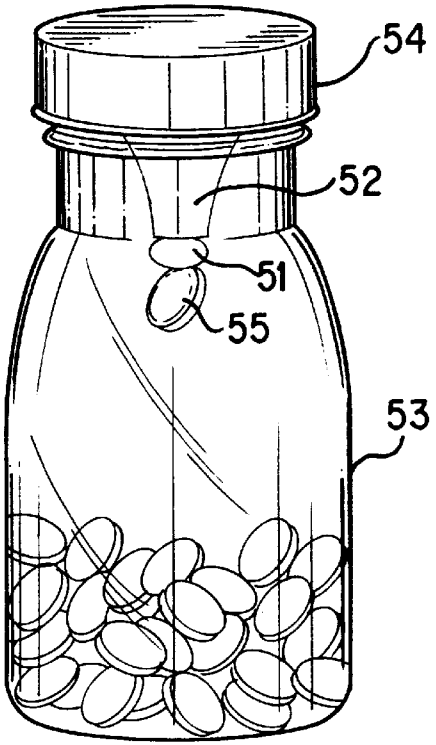
FIG. 5 shows another embodiment of the present invention comprising an adhesive area disposed on the tip of a stem fixed to a cap sealing a bottle containing pills, the stem extending into the bottle.
Figure 6:
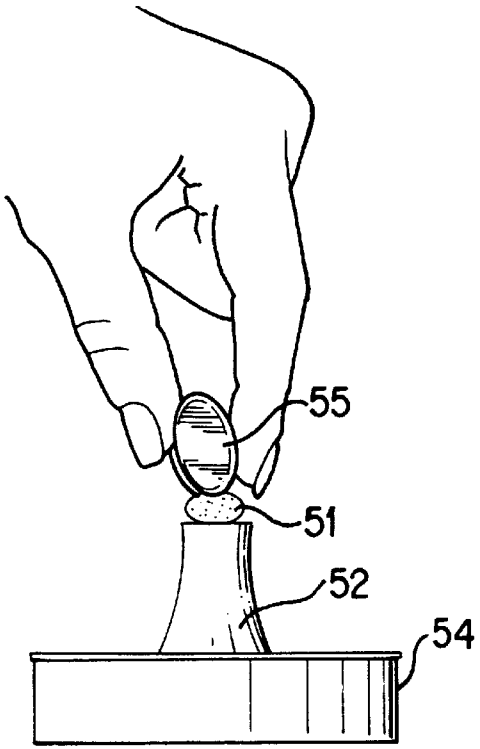
FIG. 6 shows a pill releasably fixed to the adhesive area disposed on the end of the stem fixed to the cap of FIG. 5.

In another embodiment shown in FIG. 5, the present invention is comprised of a adhesive area 51 disposed on the end of a stem 52 that is fixed to the inside surface of a cap 54, extending into a bottle 53 when the cap 54 seals the bottle 53. When the bottle 53 is agitated, a pill 55 contacts and releasably adheres to the adhesive 51. The consumer then removes the cap 54 and the pill 55 is presented for easy removal (FIG. 6).

Figure 8:
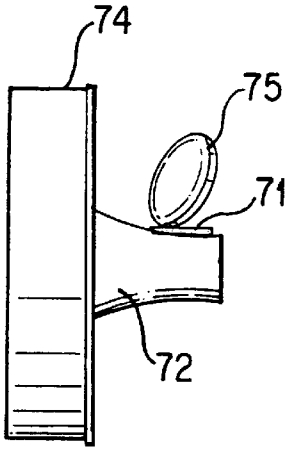
FIG. 8 shows a pill releasably fixed to the adhesive area disposed on the side of the stem fixed to the cap of FIG. 7.
Figure 7:
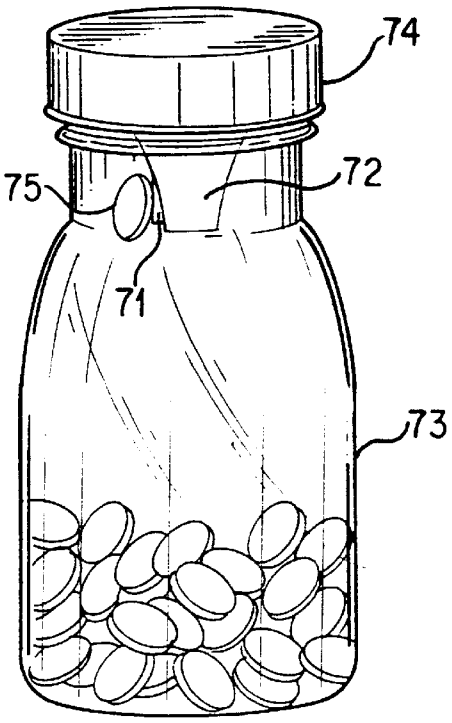
FIG. 7 shows another embodiment of the present invention comprising an adhesive area disposed on the side of a stem fixed to a cap sealing a bottle containing pills, the step extending into the bottle.

In yet another embodiment shown in FIG. 7, a adhesive 71 is disposed on the side of a stem 72 that extends into a bottle 73 from a cap 74. When the bottle 73 is agitated, a pill 75 contacts and releasably adheres to the adhesive 71. The consumer then removes the cap 74 and the pill 75 is presented for easy removal (FIG. 8).

Figure 9:
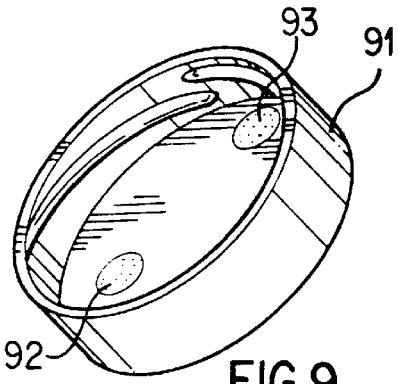
FIG. 9 shows two adhesive areas disposed on the inside surface of a cap in accordance with the present invention.

A predetermined number of pills may be retrieved in accordance with the present invention by providing more than one adhesive area on which the pills may become releasably fixed. In the embodiment shown in FIG. 9, a cap 91 is provided with a first adhesive area 92 and a second adhesive area 93. This is especially advantageous for medications which are to be taken in dosages of two pills at a time. When the cap 91 is applied to a bottle of pills (as in FIG. 3) that is then shaken or inverted, a single pill is releasably fixed to each adhesive area, and can be easily removed by the consumer in a manner similar to that shown in FIG. 4.

Figure 10:
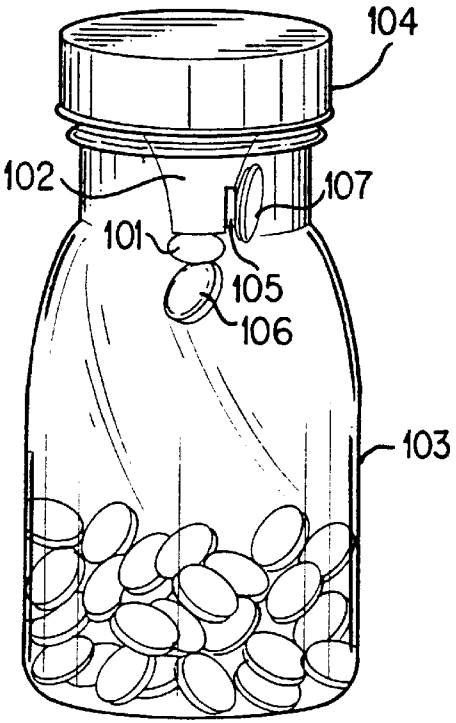
FIG. 10 shows two adhesive areas disposed on a stem in accordance with the present invention.

Likewise, in another embodiment shown in FIG. 10, a first adhesive area 101 is disposed on the end of a stem 102 that extends into a bottle 103 from a cap 104, and a second adhesive area 105 is provided on the side of the stem 102. When the bottle 103 is agitated, a first pill 106 contacts and releasably adheres to the first adhesive area 101, and a second pill 107 contacts and adheres to the second adhesive area 105. The consumer then removes the cap 104 and the first pill 106 and second pill 107 are conveniently presented to the consumer for easy removal.

More than two adhesive areas may by provided on the cap or stem to reliably and conveniently provide multi-pill dosages to the consumer.

Figure 12:
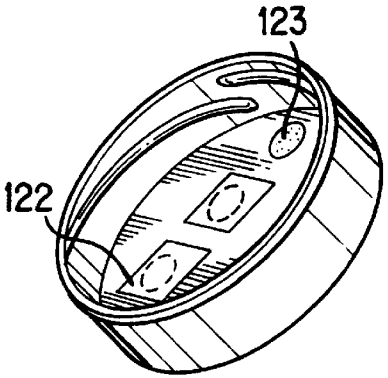
FIG. 12 shows the cap of FIG. 11 with one of the removable tabs removed, exposing an adhesive area.
Figure 15:
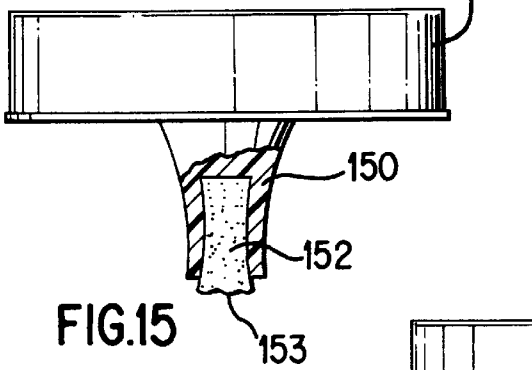
FIG. 15 shows a hollow stem filled with adhesive, the adhesive terminating in an exposed adhesive area at the end of the stem in accordance with the present invention.
Figure 11:
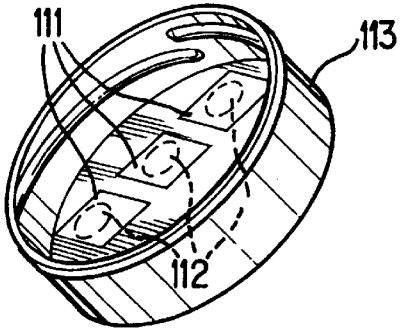
FIG. 11 shows adhesive areas covered with removable tabs disposed on the inside surface of a cap in accordance with the present invention.

A general purpose multi-pill dispenser is shown in FIG. 11. Tabs 111 that are easy to remove are provided that cover multiple adhesive areas 112 provided on the inside of a cap 113. The material of which tabs 111 are made or with which tabs 111 are coated is advantageously selected to make the tabs 111 adhere poorly to adhesive areas 112 in well known fashion. If the consumer is prescribed a single pill dosage, the consumer removes a single tab (FIG. 12) and leaves the other tabs 122 intact. Thus, the invention provides a single adhesive area 123 to the inside of a bottle when the consumer wishes to reliably extract a single pill. Likewise, the consumer may remove two tabs, leaving the other tabs intact, advantageously providing two pills when the present invention is practiced.

Figure 13:
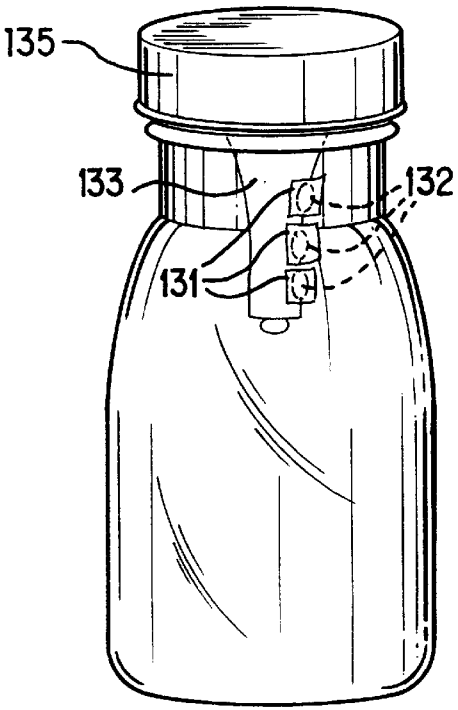
FIG. 13 shows a stem with adhesive areas covered with removable tabs in accordance with the present invention.

Similarly, removable tabs 131 may be used to cover adhesive areas 132 provided on a stem 133 that extends into a bottle 134 from a cap 135 as shown in FIG. 13.

Figure 14:
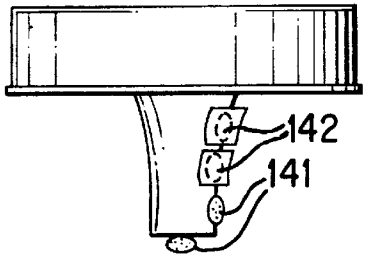
FIG. 14 shows a stem with one of the removable tabs removed, exposing an adhesive area in accordance with the present invention.

FIG. 14 shows a stem with two tabs removed and two intact, adapted to provide two pills at a time when used in accordance with the present invention. The two exposed adhesive areas 141 releasably fix pills while the two adhesive areas covered by tabs 142 do not.

Tabs may also be used to maintain the efficacy of the present invention if an adhesive area becomes contaminated and loses its adhesive properties. In this event, a removable tab is removed from another adhesive area, providing a fresh adhesive area by which pills may be fixed.

In yet another embodiment of the present invention, a hollow stem 150 is fixed to the inside surface of a cap 151, and the hollow stem 150 is filled with adhesive 152. An adhesive area 153 at the end of the stem is exposed. If the adhesive area becomes contaminated and loses its adhesive properties, the consumer grasps and pulls the contaminated adhesive and removes it, whereupon fresh, uncontaminated adhesive from inside the hollow stem is exposed at the adhesive area 153. The very good cohesive properties of FIRM GRIP, for example, ensure that the adhesive adheres to itself sufficiently that the consumer can pull fresh adhesive from inside the hollow stem 150 to the adhesive area 153 by grasping, pulling and removing the contaminated adhesive.

Figure 16:
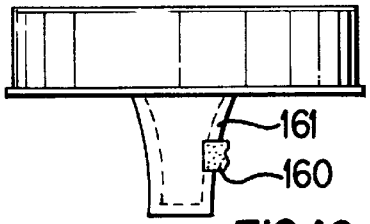
FIG. 16 shows a hollow stem filled with adhesive, the adhesive exposed at an area on the side of the stem in accordance with the present invention.

As shown in FIG. 16, the adhesive area 160 of the hollow stem 161 in accordance with the present invention can occur on the side of the hollow stem 161.

The present invention provides a convenient and economical way to extract pills from a bottle that is particularly advantageous for consumers with arthritis or other physical handicaps that interfere with their dexterity.

I claim:

1. An apparatus for dispensing pills, comprising (a) a bottle;

(b) a cap for sealing said bottle, said cap having an inside surface provided with an adhesive area that releasably fixes a pill when the pill contacts said adhesive area, wherein said adhesive area is covered by a tab, said tab being removable from said adhesive area without removing a substantial amount of adhesive from said adhesive area when said tab is removed from said adhesive area.

2. A apparatus for dispensing pills, comprising (a) a bottle;

(b) a cap for sealing said bottle, said cap having an inside surface;

(c) a stem with a base end and a distal end, said base end fixed to the inside surface of said cap, said stem provided with a adhesive area that releasably fixes a pill when the pill comes into contact with said adhesive area.

3. The apparatus of claim 2, wherein said adhesive area is disposed on the distal end of said stem.

4. The apparatus of claim 3, wherein said adhesive area is covered by a tab, said tab being removable from said adhesive area without removing a substantial amount of adhesive from said adhesive area when said tab is removed from said adhesive area.

5. The apparatus of claim 2, wherein said adhesive area is disposed on the side of said stem.

6. The apparatus of claim 5, wherein said adhesive area is covered by a tab, said tab being removable from said adhesive area without removing a substantial amount of adhesive from said adhesive area when said tab is removed from said adhesive area.

7. The apparatus of claim 2, wherein said stem defines a cavity, said cavity is at least partially filled with adhesive, and at least part of said adhesive forms said adhesive area.

8. The dispenser of claim 7, wherein said adhesive area is disposed on the distal end of said stem.

9. The apparatus of claim 8, wherein said adhesive area is covered by a tab, said tab being removable from said adhesive area without removing a substantial amount of adhesive from said adhesive area when said tab is removed from said adhesive area.

10. The dispenser of claim 7 wherein said adhesive area is disposed on the side of said stem.

11. The dispenser of claim 10, wherein said adhesive area is covered by a tab, said tab being removable from said adhesive area without removing a substantial amount of adhesive from said adhesive area when said tab is removed from said adhesive area.

12. A method of dispensing pills, comprising the steps of:

(a) sealing a bottle containing pills with a cap having an inside surface and a stem with a base end and a distal end, said base end fixed to the inside surface of said cap, said stem provided with a adhesive area that releasably fixes a pill when the pill comes into contact with said adhesive area;

(b) agitating the bottle such that a pill contacts and is releasably fixed to said adhesive area on the stem;

(c) removing said cap from the bottle;

(d) removing a pill from the adhesive area provided on the stem.

13. The method of claim 12, further comprising the step of removing a removable tab from the adhesive area before sealing the bottle with the cap.

14. A method of dispensing pills, comprising the steps of:

(a) sealing a bottle containing pills with a cap having an inside surface and a stem with a base end and a distal end, the base end of the stem fixed to the inside surface of the cap, the stem provided with an adhesive area;

(b) agitating the bottle such that a pill contacts and is releasably fixed to the adhesive area;

(c) removing the cap from the bottle;

(d) removing a pill from the adhesive area provided on the cap.

15. The method of claim 14, further comprising the step of removing a removable tab from the adhesive area before sealing the bottle with the cap.

16. An apparatus for dispensing pills, comprising:

(a) means for sealing a bottle;

(b) means for releasably fixing a pill on a stem disposed on said means for sealing a bottle.

* * * * *